US005626483A

United States Patent [19]

Naitoh

[11] Patent Number: 5,626,483

[45] Date of Patent: May 6, 1997

[54] ELECTRICAL CONNECTOR HAVING CONTACTS FORMED BY METAL PLATING

[75] Inventor: Takaki Naitoh, Inagi, Japan

[73] Assignee: The Whitaker Corporation, Wilmington, Del.

[21] Appl. No.: 514,037

[22] Filed: Aug. 11, 1995

[30] Foreign Application Priority Data

Sep. 20, 1994 [JP] Japan ..... 6-251474
Mar. 10, 1995 [JP] Japan ..... 7-079808

[51] Int. Cl.[6] ..... H01R 9/09

[52] U.S. Cl. ..... 439/74; 439/931; 439/83; 29/884; 428/209

[58] Field of Search ..... 439/931, 74, 660, 439/83, 592, 66; 428/209; 29/884

[56] References Cited

U.S. PATENT DOCUMENTS

| | | | |
|---|---|---|---|
| 4,734,045 | 3/1988 | Hawkins | 439/592 |
| 5,030,113 | 7/1991 | Wilson | 439/931 |
| 5,088,009 | 2/1992 | Harada et al. | 439/931 |
| 5,141,454 | 8/1992 | Garrett et al. | 439/931 |
| 5,246,385 | 9/1993 | Chida et al. | 439/931 |
| 5,338,209 | 8/1994 | Brooks et al. | 439/66 |
| 5,344,341 | 9/1994 | Yoshino | 439/931 |
| 5,364,277 | 11/1994 | Crumly et al. | 439/67 |
| 5,484,647 | 1/1996 | Natatani et al. | 428/209 |
| 5,535,512 | 7/1996 | Armogan | 29/884 |

FOREIGN PATENT DOCUMENTS

| | | |
|---|---|---|
| 63-50482 | 3/1988 | Japan . |
| 2-78171 | 3/1990 | Japan . |
| 5-283842 | 10/1993 | Japan . |

*Primary Examiner*—David L. Pirlot
*Assistant Examiner*—Brian J. Biggi

[57] ABSTRACT

The present invention is directed to presenting a connector which has conductor patterns in very narrow pitch. A frame 50, in which plural beams 52, which have the same cross-section as a connector 1, are aligned in parallel, is molded from a suitable resin which is good in heat resistance and accepts plating. After electroless plating over the surface of each beam 52, resist is coated uniformly thereon. The beam 52 is exposed three-dimensionally using mirrors and masks. After removing resist and unnecessary plated copper, it is gold-plated or solder plated, as needed. The beams 52, on which the conductor patterns are formed, are separated from the frame 50, and by cutting each beam into a designed number, connectors of narrow pitch are obtained.

8 Claims, 9 Drawing Sheets

ELECTRICAL CONNECTOR HAVING CONTACTS FORMED BY METAL PLATING

FIELD OF INVENTION

The present invention relates to an electrical connector, in particular, a high density connector of which the contacts are formed by plating.

BACKGROUND OF THE INVENTION

With increasing density of electronic devices, the number of contacts of circuit board connectors loaded on a circuit board is increasing and becoming more dense. Generally, such a circuit board connector comprises a first connector which has resilient metal contacts and a second connector which has nonresilient metal contacts.

Among these, the second connector is conventionally manufactured by combining a rigid housing made of insulating resin and many nonresilient metal contacts. The manufacturing method of the second connector may be (1) an insertion method in which contacts formed by stamping and/or forming are fixed in a housing by pressing or snapping the contacts in or on the housing; or (2) an injection molding method in which the contacts formed in the same manner as described in the foregoing are positioned in the mold into which insulating resin is injected to fix the contacts in the housing.

Furthermore, another connector manufacturing method is directed to a method of injection mold circuit device of which the surface is partly covered with a metal by plating, etc. (Molded Interconnection Device, hereafter called MID). The two-shot mold method is the method in which a double molding is performed with the resin, which can accept plating, and the resin, which cannot accept plating, and the metal coating is formed only on the resin which can accept plating.

The connector manufactured by using such a two-shot mold method is disclosed in Japanese Patent Publication No. 2-78171. FIGS. 15 and 16 show the manufacturing process of such a connector. First, a resin, which cannot accept plating, is molded to form an insulating base 100 of which the cross section is approximately of an inverted T-shape. Then, a resin, which can accept plating, is molded in the narrow grooves 102 of the insulating base 100 to form contact regions 104 (FIG. 16), and by plating, using a runner 106 as the plating electrode, metal coatings are formed only on the surface of the contact regions 104. Subsequently, by cutting the gates 108, the connector, of which the conductor patterns are formed in the designed pitch, is completed.

However, with the increasingly narrower pitch and high number of terminals, the following problems arise in the conventional connector which is made by the combination of the insulating resin housing and the metal contacts. That is, the increasingly narrower pitch causes difficulty in the formation of the contacts and the housing, as well as the difficulty in assembly of the contacts to the housing. Furthermore, because of such difficulties, the manufacturing cost rises. Also, the increasing number of terminals causes nonuniformity in the soldered surface of the contacts to the circuit board, and it becomes difficult to maintain the coplanarity of the soldered surface. Furthermore, it is necessary to improve the precision in position in order to attain the designed pitch between the contacts.

Now, in the case of the connector to which the two-shot mold method of MID is applied, it is practically impossible to form conductor patterns in narrow pitch, for example, 0.5 mm pitch, etc., since the conductor patterns are formed by double molding. This is because, with an increasingly narrower pitch, the volume of the contact region is drastically decreased, and the flow of the resin, which accepts plating, is impeded. Also, since the gates 108 are in a single row, the conductor patterns are also in a single row, which is inappropriate for the connector of high density. Furthermore, since the molds are required for the two resins, this results in a higher manufacturing cost.

Consequently, the objective of the present invention is to provide a connector which solves the aforesaid problems.

SUMMARY OF THE INVENTION

In a connector on which a number of conductor patterns can be formed by three-dimensional plating on a surface of a housing thereof, the present invention features the housing comprising a single resin which can accept plating and is heat resistant, and the conductor patterns are formed to the designed patterns by photolithography of the plated layer which is formed over a roughened whole surface of the housing.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
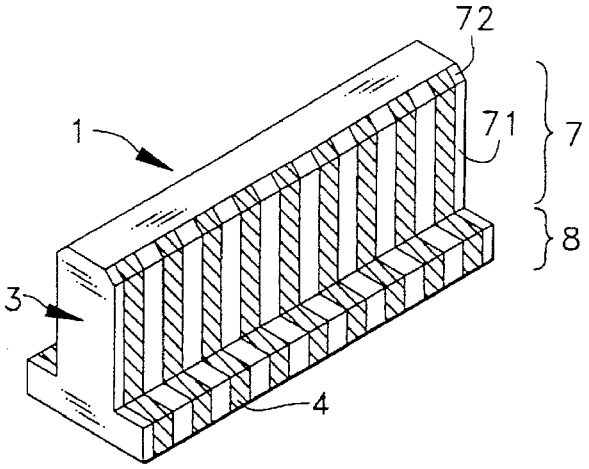
FIG. 1 is a perspective view of a plug connector of an embodiment of the present invention.
Figure 2:
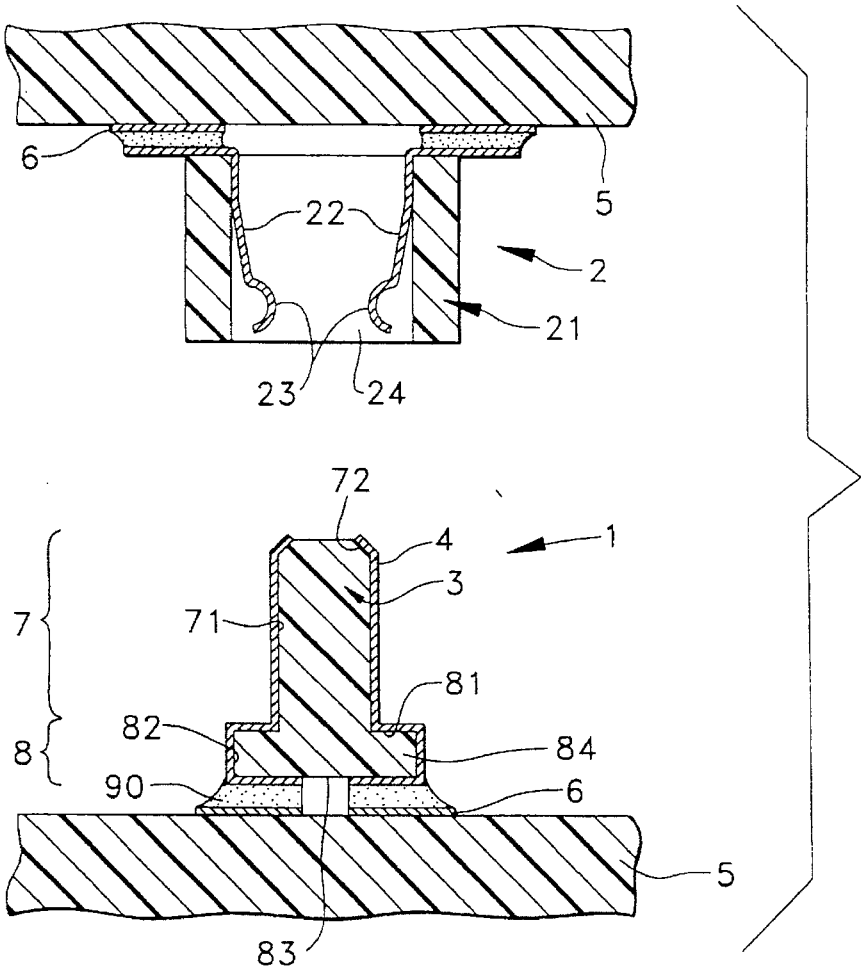
FIG. 2 is an exploded cross-sectional view of the condition before the plug connector in FIG. 1 and a receptacle connector, which has spring contacts, are connected.

In the following, embodiments of the present invention are explained referring to the attached drawings. FIG. 1 is a perspective view of a plug connector as an embodiment of the present invention. FIG. 2 is a cross-sectional view of the condition before the plug connector in FIG. 1 and a receptacle connector, which has spring contacts, are connected.

Plug connector 1 has a plug housing 3 and many conductor patterns 4 which are formed on the surface of the plug housing 3 in designed spacing. Also, housing 3 has a contact section 7, which contacts with spring contacts 22 of a receptacle connector 2, and a soldering section 8, which is solder-connected to contact pads 6 of circuit board 5.

The plug housing 3 is made of a resin such as liquid crystal polymer, PPS, nylon, etc., which is heat resistant enough to allow reflow-soldering and also accepts plating. Incidentally, the resin preferably contains inorganic filler, etc. The contact section 7 has side surfaces 71, which are parallel to the inserting direction to the receptacle connector 2, and at their outer corners tapered surfaces 72 or rounded surfaces (not shown) are formed in order to ease the insertion into the receptacle 2. Also, the soldering section 8 has protrusions 84, which protrude from the side surfaces 71 of the contact section 7 and they are intended to form good soldering fillets 90 and also to prevent the solder from wicking onto the contact section 7. The good soldering fillets 90 improve the soldering strength, and at the same time ease the visual inspection of the solder fillets. Due to the soldering section 8 being sufficiently high, the solder does not wick onto the contact section 7; therefore, the protrusions 84 provide an important function.

For the conductor patterns 4, in case the surface treatment of the contacts 22 of the other connector is solder plating or tin plating, the whole surface is primed with copper plating, then nickel plating, and then solder plating or tin plating is carried out. Also, in case the surface treatment of the contacts 22 of the other connector is gold plating, the contact section 7 is primed with copper plating, then nickel plating, and then, preferably gold plating is carried out partly, and the soldering section 8 is primed with copper plating or plated with tin. However, if the soldering section is not high enough, it is difficult to gold-plate partly; and therefore, the whole surface of the conductor patterns 4 is primed with copper plating, then nickel plating, and then, the whole surface is plated with gold.

The connector 1 has two rows of conductor patterns in the form of electrical contacts 4. Therefore, many conductor patterns 4 are formed on each of the left and right surfaces of the plug housing with designed spacing; they extend along the side surfaces 71 of the contact section 7 of the plug housing 3, along the top surfaces 81, side surfaces 82 and bottom surfaces 83 of protrusions 84 of soldering section 8 as continuous contacts 4.

The receptacle connector 2 has spring contacts 22 made of metal such as copper alloy, etc. with the contacts having resiliency and conductivity. As contacts of the receptacle connector 2 which engage with the nonelastic connector 1, elastomer contacts (not shown) instead of metal spring contacts can also be used. As examples of the elastomer contacts, there are those for which elastomers such as silicone rubber, urethane rubber, etc. are wrapped with a flexible printed cable FPC on which parallel conductor patterns are formed, those for which fine particles of silver, gold, platinum, nickel, solder, etc. are dispersed in silicone rubber, or those for which fine wires of gold, iron, copper, etc. are embedded only in one direction, top to bottom, in silicone rubber, and so forth.

When the plug connector 1 is connected to the receptacle connector 2, the contact section 7 of the plug connector 1 is inserted in cavity 24 of the receptacle housing 21, and the contact sections 23 of the spring contacts 22 electrically engage respectively with the conductor patterns or contacts 4 of the contact section 7 by a wiping action, and an electrical connection is obtained in this manner whereby two circuit boards 5 are mutually electrically connected together.

Figure 3:
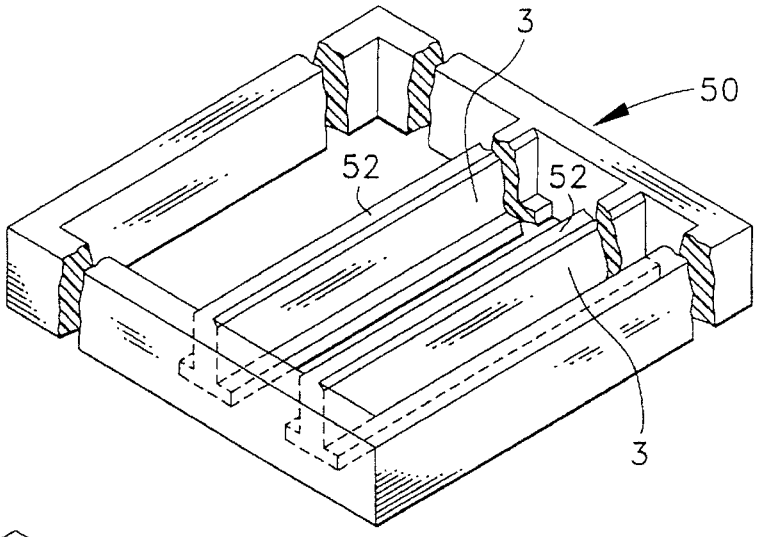
FIG. 3 is a perspective view showing a molding partly in section for obtaining multiple housings of the plug connector of FIG. 1.

FIG. 3 is a perspective view showing a molding for obtaining multiple housings 3 of the plug connection 1 in FIG. 1. The manufacturing process of the plug connector in FIG. 1 is according to the following. First, as shown in FIG. 3, frame 50, in which plural beams 52 having a cross-section of the same shape as the housing 3, are aligned in parallel, is molded using the aforesaid resin material. The size of the frame depends on the size of the connector, but it is rectangular with a side of 100–150 mm and its thickness is the same as the height of the connector.

Subsequently, the surface of the beams 52 undergoes an etching treatment (surface-roughening) with KOH aqueous solution, etc. and catalyst treatment, and then, electroless plating is carried out on the whole surface. Then, the whole surface is uniformly coated with a resist by an electrodeposition method, spraying method, dipping method, etc.

The subsequent exposure process is the most important for carrying out a three-dimensional patterning of the conductor patterns. Usually, if the rising angle of the surface of the molding is less than 60° and the exposure is to be carried out on a less than even single side, one exposure with a single light source should do. However, in case there is such a surface that has to be exposed three dimensionally as the connector 1 in FIG. 1, either the exposure is divided into several times, or a single exposure is carried out using plural light sources, or, as disclosed in Japanese Patent Publication No. 5-188599, which discloses a method to make a single exposure with a single or plural light sources using reflectors. In the present example, the last method is preferred while using designed masks.

After the exposure process, by removing the resist from the area other than conductive patterns 4, then removing the electrolessly plated copper by acid, etc., and then removing the resist on the conductor patterns 4, the three-dimensional conductive patterns 4 are formed. Subsequently, copper plating is carried out by electrolytic or electroless plating (additive method), and on top of this, nickel plating and gold plating, or nickel plating and solder plating, etc., are carried out as needed.

After the formation of the conductive patterns 4, each beam 52 is cut and separated from the frame 50, and also, each beam 52 is cut to a designated length and plural connectors 1 are obtained. In this manner, by producing multiple housings out of a single molding and also forming conductive patterns 4 on the multiple housings simultaneously by photolithography, many connectors 1 can be obtained by a simple manufacturing process and at low cost. Also, since the conductive patterns 4 are formed directly on the surface of the relatively rigid housing 3, coplanarity of the soldering connections can be realized. Incidentally, in the foregoing the application of positive photolithography has been described, but also negative photolithography can be applied.

Figure 4:
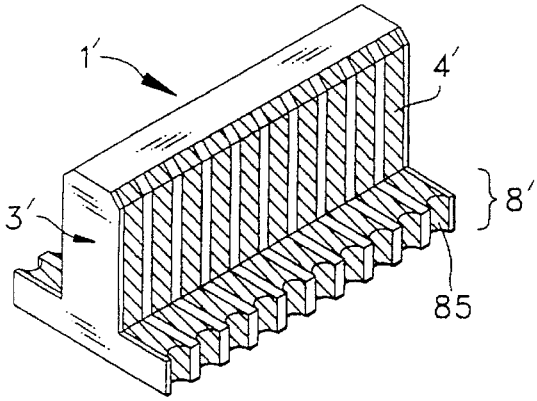
FIG. 4 is a perspective view showing a plug connector of another embodiment of the present invention.

FIG. 4 is a perspective view showing a plug connector 1' as another embodiment of the present invention. Its difference from the plug connector 1 in FIG. 1 is that the conductor patterns 4' in the soldering section 8' are formed on the arcuate walls 85.

Figure 5:
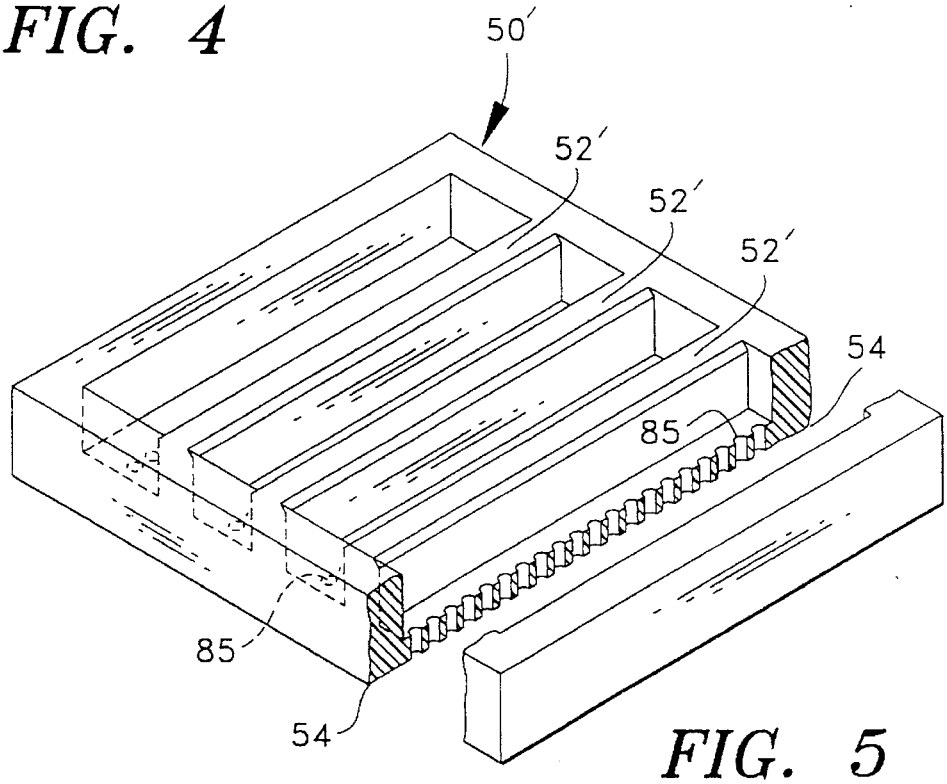
FIG. 5 is a perspective view showing a molding partly in section for obtaining multiple housings of the plug connector in FIG. 4.

FIG. 5 is a perspective view showing a molding for obtaining multiple housings for the plug connector in FIG. 4. Incidentally, a part of it is cross sectioned for the sake of clarity. The difference of the frame 50' from the frame 50 is that through holes 85 are formed in alignment parallel to the beams 52' between the beams 52' and the ends of frame 50' and between the neighboring beams 52' instead of rectangular openings parallel to the beams 52'. The manufacturing process of the plug connector 1' in FIG. 4 is about the same as that of the plug connector 1 but is different in that the frame shown in FIG. 5 is molded at the outset, and that, when the beams, on which the conductive patterns 4' are formed, are separated from the frame 50', the cutting process along the centers of the through holes 85, for example, along the line 54—54, is added thereby forming the arcuate walls 85.

Figure 6:
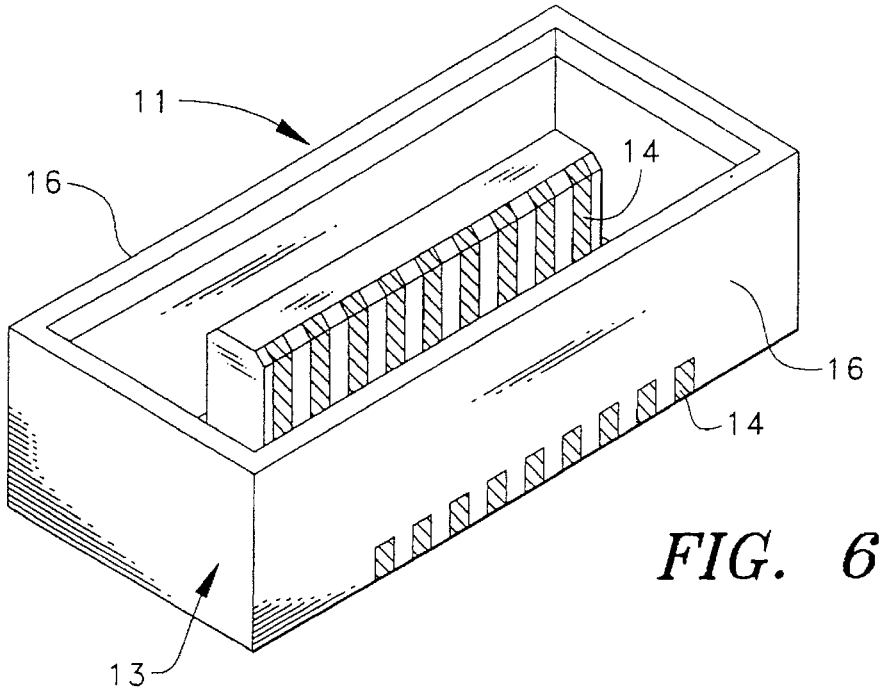
FIG. 6 is a perspective view showing a plug connector of yet another embodiment of the present invention.
Figure 7:
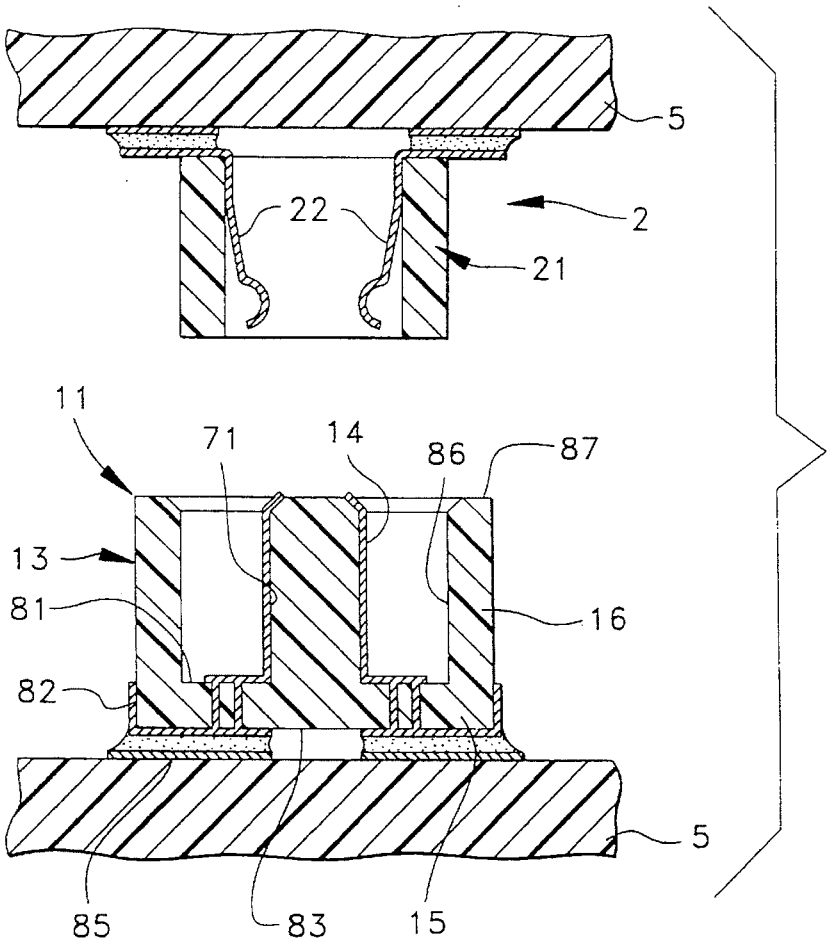
FIG. 7 is a cross-sectional view of the condition before the plug connector in FIG. 6 and a receptacle connector, which has spring contacts, are connected.

FIG. 6 is a perspective view showing the plug connector 11 of yet another embodiment of the present invention. FIG. 7 is a cross-sectional view of the condition before the plug connector 11 of FIG. 6 and the receptacle connector 2, which has spring contacts 22, are connected. Incidentally, the same reference numbers are given to the parts corresponding to those in FIG. 1 and FIG. 2. The difference of the plug connector 11 in FIG. 6 from the plug connector 1 in FIG. 1 is that the plug housing 13 has side walls 16 which are connected to a bottom wall 15. In order to shorten the electrical path of the conductive patterns 14, the conductive patterns 14 extend along side surfaces 71 of the contact section 7, along an upper surface 81 of the bottom wall 15, the arcuate walls 85, a bottom surface 83 of the bottom wall 15, and the side surface 82 of side walls 16 as continuous patterns. The through holes 85 have a diameter 0.2–0.5 mm, preferably 0.2–0.25 mm and are formed through the bottom wall 15 at a designed pitch when the plug housing 13 is molded. On the inner wall of the through holes 85, conductive patterns are formed by plating. In this case, since the whole surface of the housing 13 undergoes electroless copper plating, followed by electrolytic copper thick plating, the conductive patterns are securely formed. Incidentally, the through holes can be formed through the side walls 16 instead. Also, in case the through holes are aligned in a narrow pitch, they can be in two rows or in zigzag alignment. For example, if the through holes are 0.5 mm in diameter and are aligned in a row, it is difficult to form conductive patterns at a 0.5 pitch, but if the through holes 0.5 mm in diameter are aligned in a zigzag manner and the width of the conductive patterns is made less than 0.5 mm, it is therefore possible to form conductive patterns of 0.5 mm pitch. Also, it is possible to extend the conductive patterns 14 from the side surfaces 71 by way of the upper surface 81 of the bottom wall, the inner surfaces 86 of the side walls 16, the top surface 87, and the outer side surface 82, to the bottom surface 83 as continuous patterns. Although in this case the electrical path is longer, there is no need to form the through holes 85.

Figure 8:
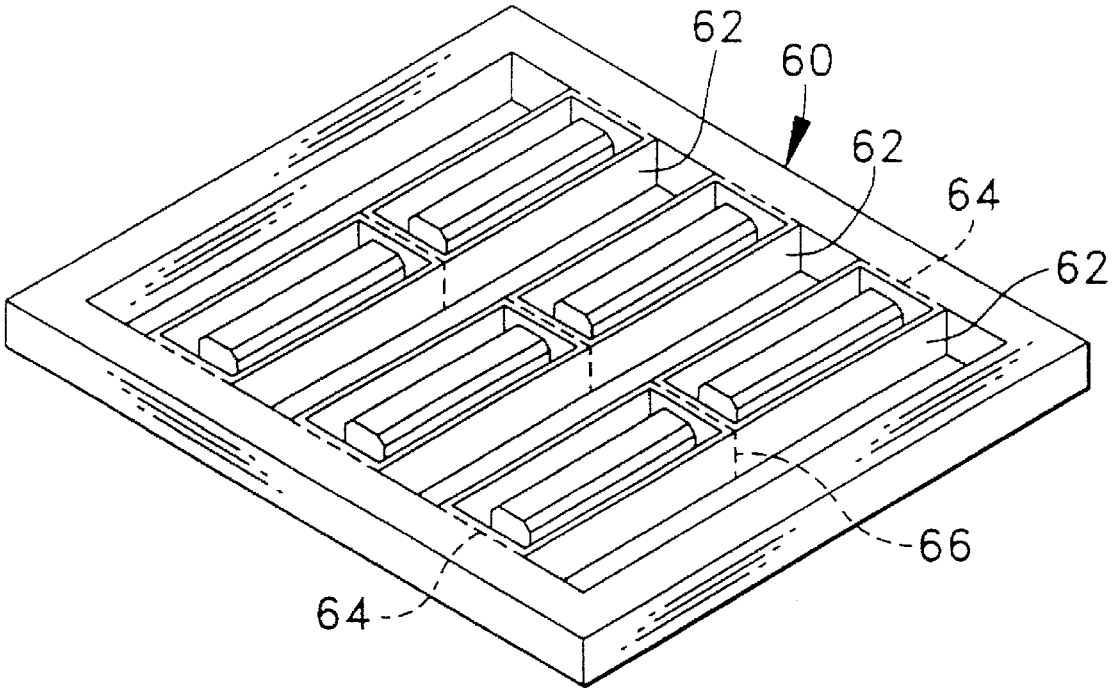
FIG. 8 is a perspective view showing a molding for obtaining multiple housings of the plug connector in FIG. 6.

FIG. 8 is a perspective view showing a molding for obtaining multiple housings for the plug connector in FIG. 6. The manufacturing process of the plug connector in FIG. 6 is about the same as that of the plug connector in FIG. 1 except that the frame 60 is molded at the outset. The beams 62, on which the conductive patterns 14 are formed, are separated from the frame 60 by cutting along the dashed lines 64, and the individual plug connector is obtained by cutting each beam 62 along the dashed lines 66.

Figure 9:
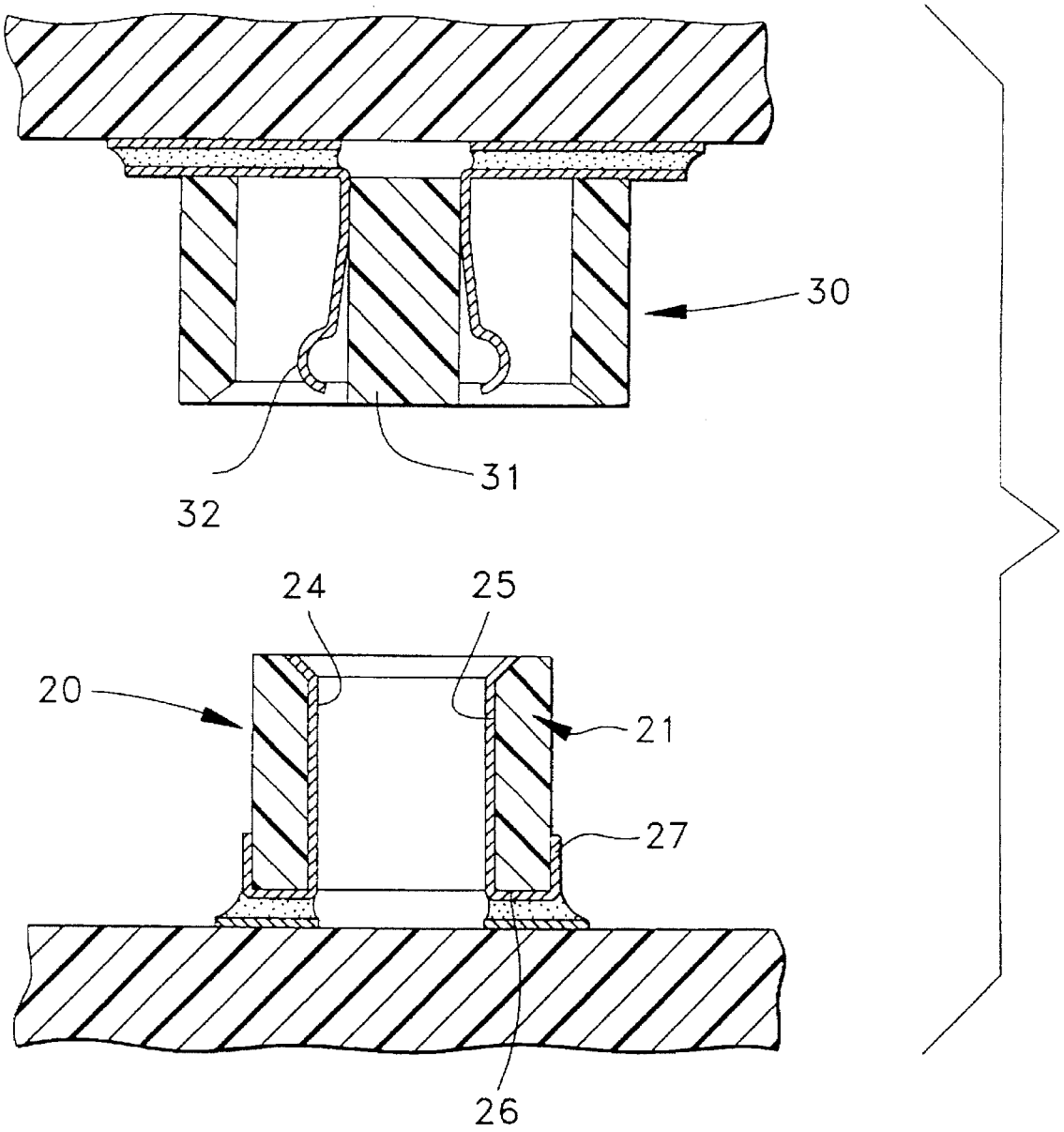
FIG. 9 is a cross-sectional view of the condition before a receptacle connector of an additional embodiment of the present invention and a plug connector, which has spring contacts, are connected.
Figure 10:
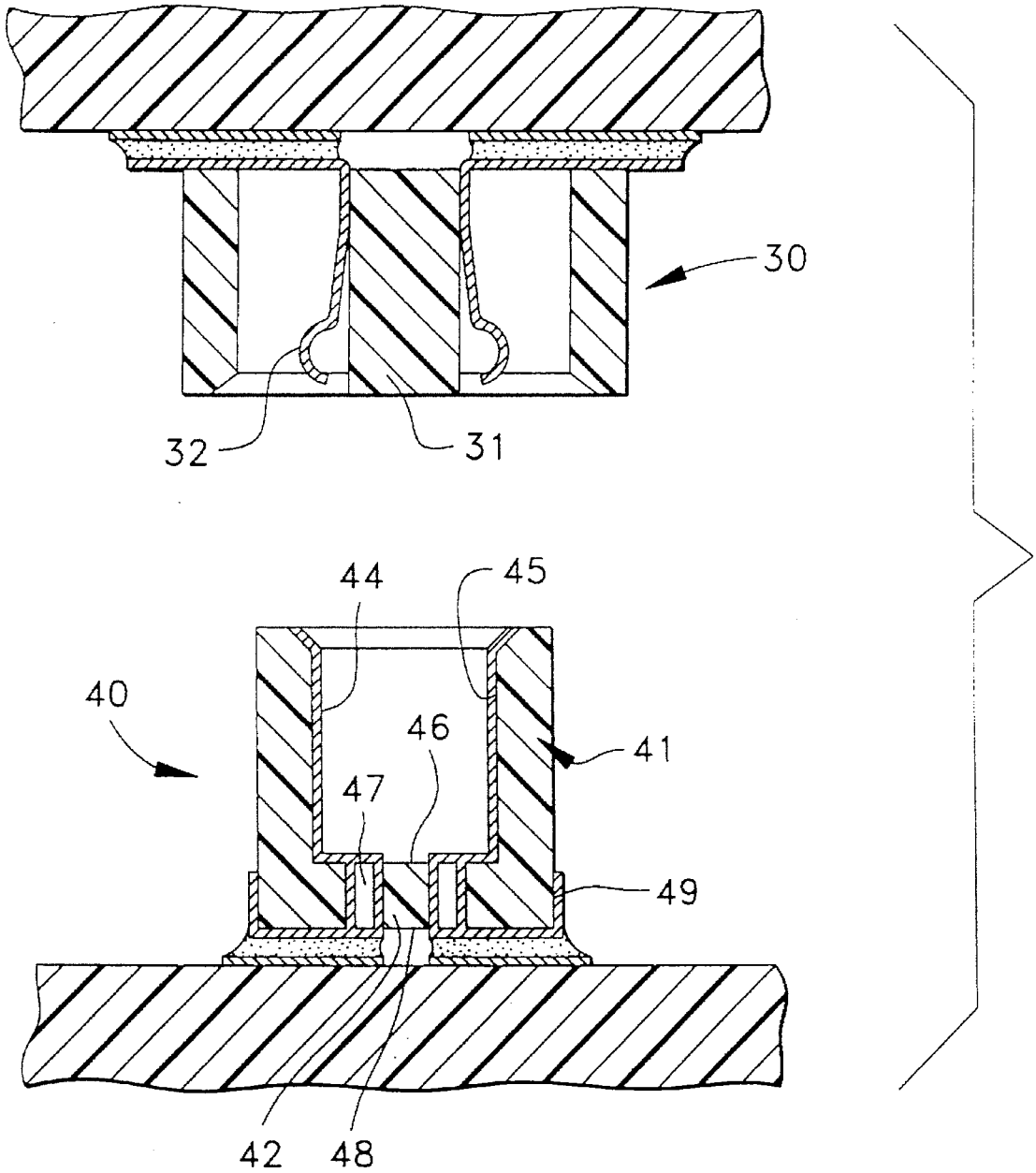
FIG. 10 is a cross-sectional view of the condition before a receptacle connector of a further embodiment of the present invention and a plug connector, which has spring contacts, are connected.

FIG. 9 is a cross-sectional view of the condition before the receptacle connector of an additional embodiment of the present invention and the plug connector, which has spring contacts, are connected. FIG. 10 is a cross-sectional view of the condition before the receptacle connector of a further embodiment of the present invention and the plug connector, which has spring contacts, are connected. As clear from FIG. 9 and FIG. 10, the present invention can be applied to the receptacle connector too.

In FIG. 9, the housing 21 of the receptacle connector 20 is a frame of side and end walls only without a bottom wall. The conductive patterns 24 extend along inner surfaces 25 of the housing 21, along a bottom surface 26 and along outer surfaces 27 in a continuous manner.

In FIG. 10, the housing 41 of the receptacle connector 40 is in the shape of a box which has bottom wall 42. The conductor patterns 44 extend along inner surfaces 45 of the housing 41, along an upper surface 46 of the bottom wall 42, along through holes 47, along bottom surface 48 of the bottom wall 42, and along outer surfaces 49 in a continuous manner.

Figure 11:
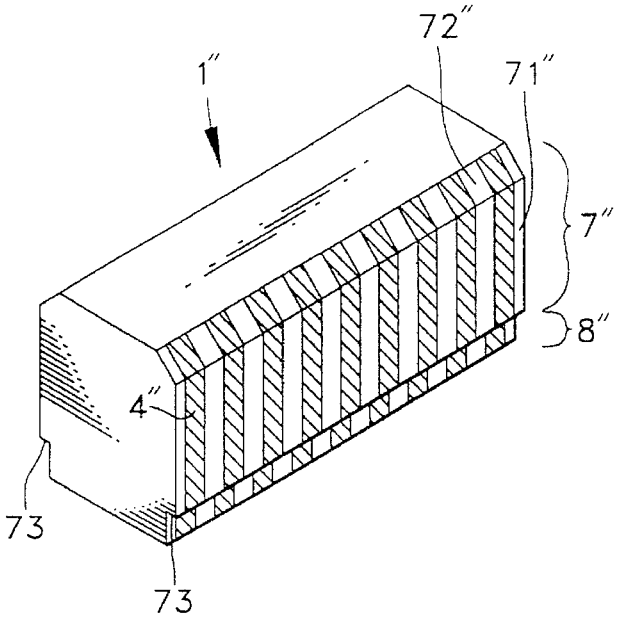
FIG. 11 is a perspective view of a plug connector of a still additional embodiment of the present invention.
Figure 12:
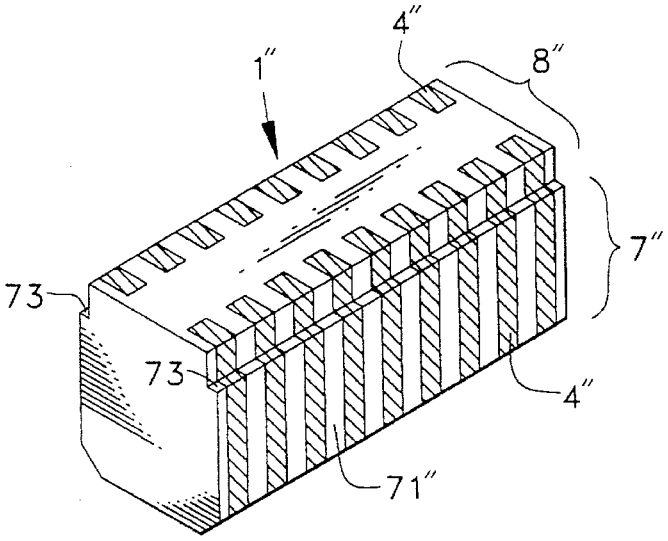
FIG. 12 is a view similar to FIG. 11 showing the plug connector in an inverted position.

FIGS. 11 and 12 show a plug connector of a still additional embodiment of the present invention. The difference of the plug connector 1" of FIGS. 11 and 12 from the plug connector of FIG. 1 is that the soldering section 8" is indented relative to the side surfaces 71" of the contact section 7". The bottom surfaces 73 between the contact section 7" and the soldering section 8" prevent solder from climbing to the conductor patterns 4" of the contact section 7". Incidentally, the depth of the indentation of the soldering section 8" should preferably be shallow at such level so that it allows for visual inspection of the solder fillets that are formed.

Figure 13:
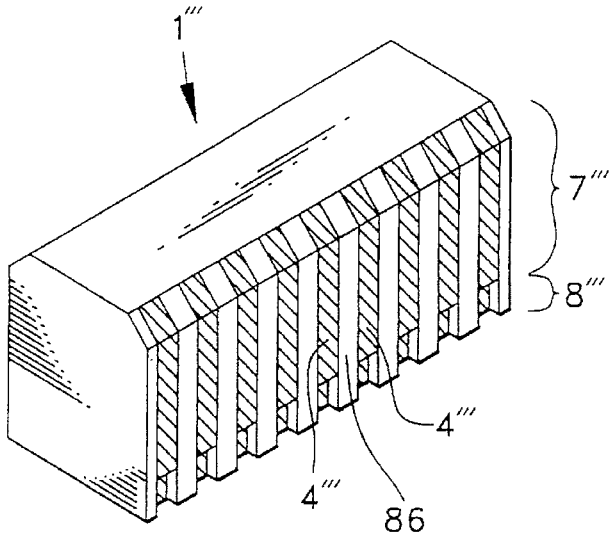
FIG. 13 is a perspective view of a plug connector of yet a further embodiment of the present invention.
Figure 14:
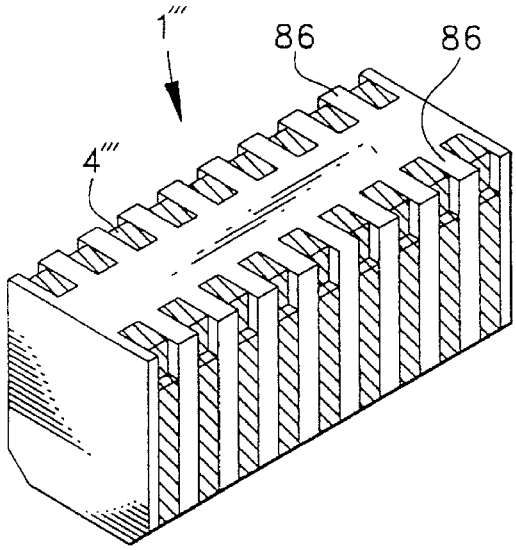
FIG. 14 is a view similar to FIG. 13 showing the plug connector in an inverted position.
Figure 15:
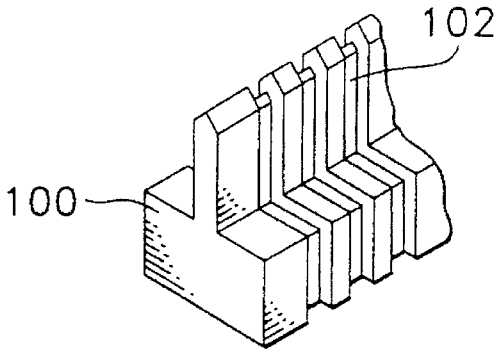
FIG. 15 (PRIOR ART)
FIGS. 15 and 16 are perspective views showing a conventional manufacturing process of a plug connector with FIG. 15 showing an insulating base, and FIG. 16 showing the process of forming contact regions.
Figure 16:
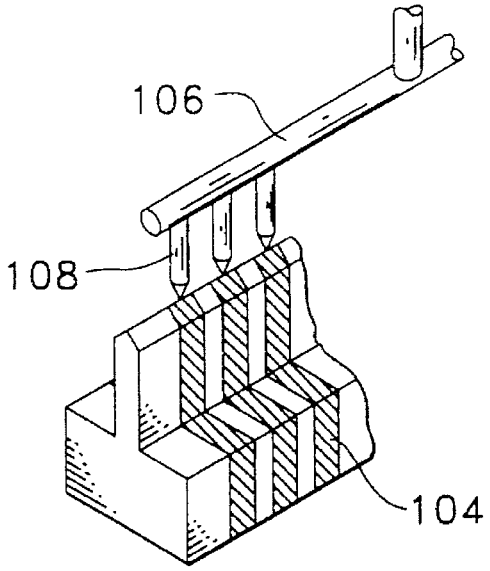
FIG. 16 (PRIOR ART)

FIGS. 13 and 14 show a plug connector of yet a further embodiment of the present invention. The difference of the plug connector 1" of FIGS. 11 and 12 from the plug connector 1'" is that partitions 86 are formed between the conductor patterns 4'" of the soldering section 8'". By these partitions, short-circuiting between neighboring conductor patterns 4'" is prevented.

The connectors shown in FIG. 9 through FIG. 14 can be manufactured by the same process as the manufacturing process of the connector 1 in FIG. 1.

In the foregoing, embodiments of the present invention have been described in detail, but the present invention is not limited thereto, and it is possible they can be modified or changed in various manners as needed. For example, although the connectors of the presently-described embodiments are for circuit boards which are placed horizontally, by forming the housing and the conductor patterns in such a way that the relative positions of the contact section and the soldering section of the plug connector or the receptacle connector are turned by 90°, the connector for the circuit boards positioned vertically can be obtained. Also, the relative position of the contact section and the soldering section can be at other angles too.

According to the connector of the present invention, it is possible to obtain a high density connector which has conductor patterns at a very narrow pitch; for example, 0.5 mm pitch, etc., and the soldering section has very good planarity.

I claim:

1. An electrical connector comprising:

a dielectric housing made of a heat-resistant plastic that can accept metal plating and having a roughened surface covered with a metal layer, a conductor pattern formed by photolithography on the metal layer, excess metal removed from the housing leaving the conductor pattern thereon in the form of closely spaced contact members, the housing including a contact section and a soldering section, with the contact members extending along one surface of the contact section and along one part of the soldering section including a side surface and a bottom surface of the soldering section, and the side surface of the soldering section having arcuate depressions along which the contact members extend.

2. An electrical connector as claimed in claim 1, wherein the housing has a T-shaped configuration wherein a vertical leg defines the contact section and a horizontal leg defines the soldering section.

3. An electrical connector as claimed in claim 1, wherein the soldering section is indented relative to side surfaces of said contact section.

4. An electrical connector as claimed in claim 1, wherein partitions are located on said housing along said soldering section between the contact members.

5. A method of making electrical connectors, comprising the steps of:

molding a rectangular frame from a heat-resistant plastic that can accept metal plating, the frame including housing members each having a contact section and a soldering section extending between side walls of said frame at spaced locations therealong;

providing a roughened surface on each of the housing members;

covering the roughened surfaces with a metal layer;

coating the metal layer with a resist material;

exposing the resist material thereby forming a conductor pattern along the contact section and the soldering section;

removing the metal that is not the conductor pattern;

removing the resist covering the conductor pattern; and plating a metal onto the conductor pattern whereby contact members are formed along the contact section and the soldering section of the housing members thereby forming electrical connectors.

6. A method of making electrical connectors as claimed in claim 5, comprising the further step of removing the electrical connectors from the rectangular frame.

7. A method of making electrical connectors as claimed in claim 5, wherein the step of providing a roughened surface constitutes etching the surface.

8. An electrical connector comprising:

a dielectric housing made of a heat-resistant plastic that can accept metal plating and having a roughened surface covered with a metal layer, a conductor pattern formed by photolithography on the metal layer, excess metal removed from the housing leaving the conductor pattern thereon in the form of closely spaced contact members, the housing having a box-shaped configuration including a contact section and a soldering section, the contact section extending upwardly from a bottom wall which defines the soldering section, the contact members extending along the contact section and through holes in the bottom wall and along an outer surface of the bottom wall.

* * * * *